US008280286B2

(12) United States Patent
Condello et al.

(10) Patent No.: US 8,280,286 B2
(45) Date of Patent: Oct. 2, 2012

(54) APPARATUSES USEFUL IN PRINTING AND METHODS OF FIXING MARKING MATERIAL ON MEDIA

(75) Inventors: Anthony S. Condello, Webster, NY (US); Augusto E. Barton, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 555 days.

(21) Appl. No.: 12/490,601

(22) Filed: Jun. 24, 2009

(65) Prior Publication Data

US 2010/0330494 A1 Dec. 30, 2010

(51) Int. Cl.
*G03G 15/20* (2006.01)

(52) U.S. Cl. ..... 399/320; 399/67; 399/68

(58) Field of Classification Search ..... 399/320, 399/67–69

See application file for complete search history.

(56) References Cited

U.S. PATENT DOCUMENTS

| | | | | |
|---|---|---|---|---|
| 6,564,033 | B2 | 5/2003 | Zhou et al. | |
| 7,228,082 | B1 | 6/2007 | Davidson et al. | |
| 2003/0228179 | A1 | 12/2003 | Yaomin et al. | |
| 2004/0228667 | A1 * | 11/2004 | Eskey | 399/334 |
| 2005/0006370 | A1 | 1/2005 | Suzumi | |
| 2005/0036809 | A1 * | 2/2005 | Fukita et al. | 399/328 |
| 2006/0210331 | A1 | 9/2006 | Baba et al. | |
| 2007/0048035 | A1 | 3/2007 | Baba et al. | |
| 2007/0048042 | A1 | 3/2007 | Uehara et al. | |
| 2007/0092277 | A1 | 4/2007 | Miyata et al. | |
| 2007/0166084 | A1 | 7/2007 | Yoshino et al. | |
| 2007/0172272 | A1 | 7/2007 | Miyata et al. | |
| 2008/0037069 | A1 | 2/2008 | Mestha et al. | |
| 2008/0080910 | A1 * | 4/2008 | Senda et al. | 399/328 |

OTHER PUBLICATIONS

Nathan E. Smith; "Fusers, Printing Apparatuses and Methods of Fusing Toner on Media"; U.S. Appl. No. 12/244,320, filed Oct. 2, 2008.

Christine A. Keenan; "Apparatuses Useful for Printing and Methods of Stripping Media From Surfaces in Apparatuses Useful for Printing"; U.S. Appl. No. 12/352,250, filed Jan. 12, 2009.

* cited by examiner

*Primary Examiner* — Walter L Lindsay, Jr.
*Assistant Examiner* — Roy Y Yi
(74) *Attorney, Agent, or Firm* — Ronald E. Prass, Jr.; Prass LLP

(57) ABSTRACT

Apparatuses useful in printing and methods of treating marking material on media are disclosed. An embodiment of the apparatuses includes a roll including a first outer surface; a continuous belt including an inner surface and a second outer surface forming a nip by contact with the first outer surface, the belt being driven by rotation of the roll; and a heater disposed inside of the belt. The heater includes a circumferentially-extending heating surface contacting the inner surface of the belt over an angle of at least about 90°.

23 Claims, 4 Drawing Sheets

APPARATUSES USEFUL IN PRINTING AND METHODS OF FIXING MARKING MATERIAL ON MEDIA

BACKGROUND

In printing processes, images can be formed on media using marking material. Apparatuses used in such processes can include opposed members that form a nip. During printing processes, the marking material on the media is treated at the nip using the opposed members.

It would be desirable to provide apparatuses useful in printing that are more compact and can provide desirable heating and energy consumption characteristics, and to provide methods for treating marking material on media that can use such apparatuses.

SUMMARY

Embodiments of apparatuses useful for printing and methods of fixing marking material on media are disclosed. An exemplary embodiment of the apparatuses useful in printing comprises a roll including a first outer surface; a continuous belt including an inner surface and a second outer surface forming a nip by contact with the first outer surface, the belt being driven by rotation of the roll; and a heater disposed inside of the belt. The heater includes a circumferentially-extending heating surface contacting the inner surface of the belt over an angle of at least about 90°.

DRAWINGS

DETAILED DESCRIPTION

The disclosed embodiments include an apparatus useful in printing comprising a roll including a first outer surface; a continuous belt including an inner surface and a second outer surface forming a nip by contact with the first outer surface, the belt being driven by rotation of the roll; and a heater disposed inside of the belt. The heater includes a circumferentially-extending heating surface contacting the inner surface of the belt over an angle of at least about 90°.

The disclosed embodiments further include an apparatus useful in printing comprising a roll including a first outer surface; a continuous belt including an inner surface and a second outer surface, the belt being driven by rotation of the roll; a first nip formed by the second outer surface contacting the second first surface, the first nip including an inlet end where media enter the first nip and a first outlet end where media exit the first nip; a second nip formed by the second outer surface contacting the first outer surface adjacent the outlet end of the first nip, the second nip extending from about the first outlet end of the first nip to a second outlet end; a heater disposed inside of the belt, the heater including a heating surface contacting the inner surface of the belt; and a stripping member disposed inside of the belt. The stripping member includes a surface configured to contact the inner surface of the belt to produce a stripping force effective to assist stripping of media from the second outer surface after the media exit from the first nip.

The disclosed embodiments further include an apparatus useful in printing comprising a roll including a first outer surface; a continuous belt including an inner surface and a second outer surface forming a nip by contact with the first outer surface, the belt being driven by rotation of the roll; and a heater disposed inside of the belt. The heater includes a heating surface contacting a portion of the inner surface of the belt circumferentially spaced from the nip. The apparatus does not include a heater that heats the inner surface of the belt at the nip.

Figure 1:
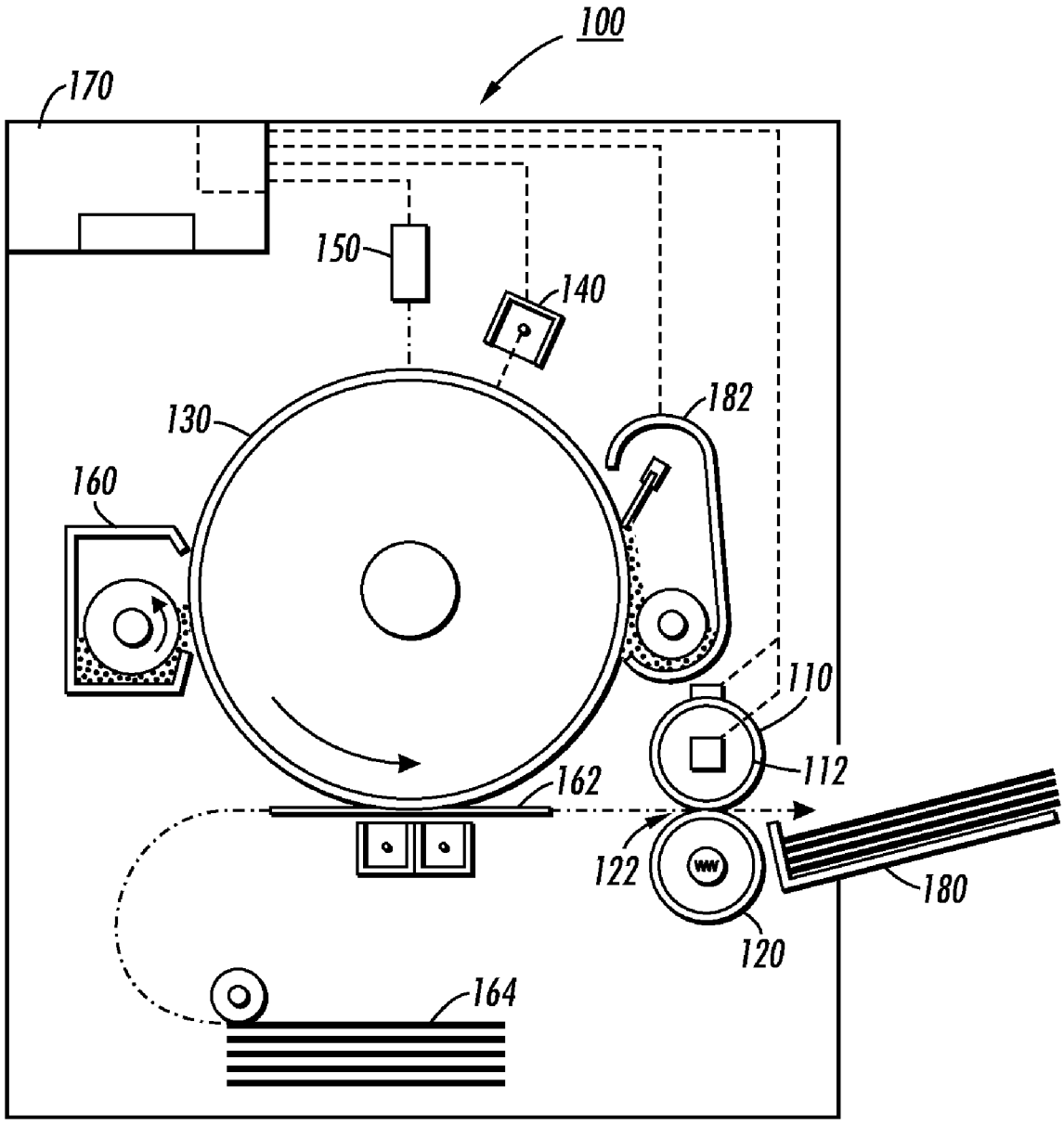
FIG. 1 depicts an exemplary embodiment of a printing apparatus.

FIG. 1 illustrates an exemplary printing apparatus 100 disclosed in U.S. Pat. No. 7,228,082, which is incorporated herein by reference in its entirety. As used herein, the term "printing apparatus" encompasses any apparatus, such as a digital copier, bookmaking machine, multifunction machine, and the like, or portions of such apparatuses, that can perform a print outputting function for any purpose. The printing apparatus 100 can be used to produce prints from various types of media, such as coated or uncoated (plain) paper sheets, having various sizes and weights.

The printing apparatus 100 includes a fuser 110 with a rotatable, continuous belt 112 and a pressure roll 120 defining a nip 122. The printing apparatus 100 further includes a rotatable photoreceptor 130. To form a toner image on the photoreceptor 130, a charging device 140 is activated to charge the outer surface of the photoreceptor 130. The photoreceptor 130 is rotated to an exposure device 150 to form an electrostatic latent image on the photoreceptor 130. Then, the photoreceptor 130 is rotated to a developer device 160, which applies marking material (toner) to the electrostatic latent image to form the toner image on the photoreceptor 130. The toner image is transferred from the photoreceptor 130 to a medium 162, e.g., a sheet of paper, conveyed from a sheet supply stack 164. The medium 162 on which the toner image has been formed is conveyed to the nip 122 of fuser 110. The printing apparatus 100 includes a controller 170 configured to control operation of the image-forming devices during printing. After the medium 162 passes through the nip 122, the medium is conveyed to an output tray 180. A cleaning device 182 removes residual toner particles from the photoreceptor 182 before the imaging process is repeated for another medium.

Apparatuses useful in printing are provided. Embodiments of the apparatuses can be used to fix marking materials on media. The apparatuses include opposed members for applying heat and pressure to media to fix marking material onto the media.

Figure 2:
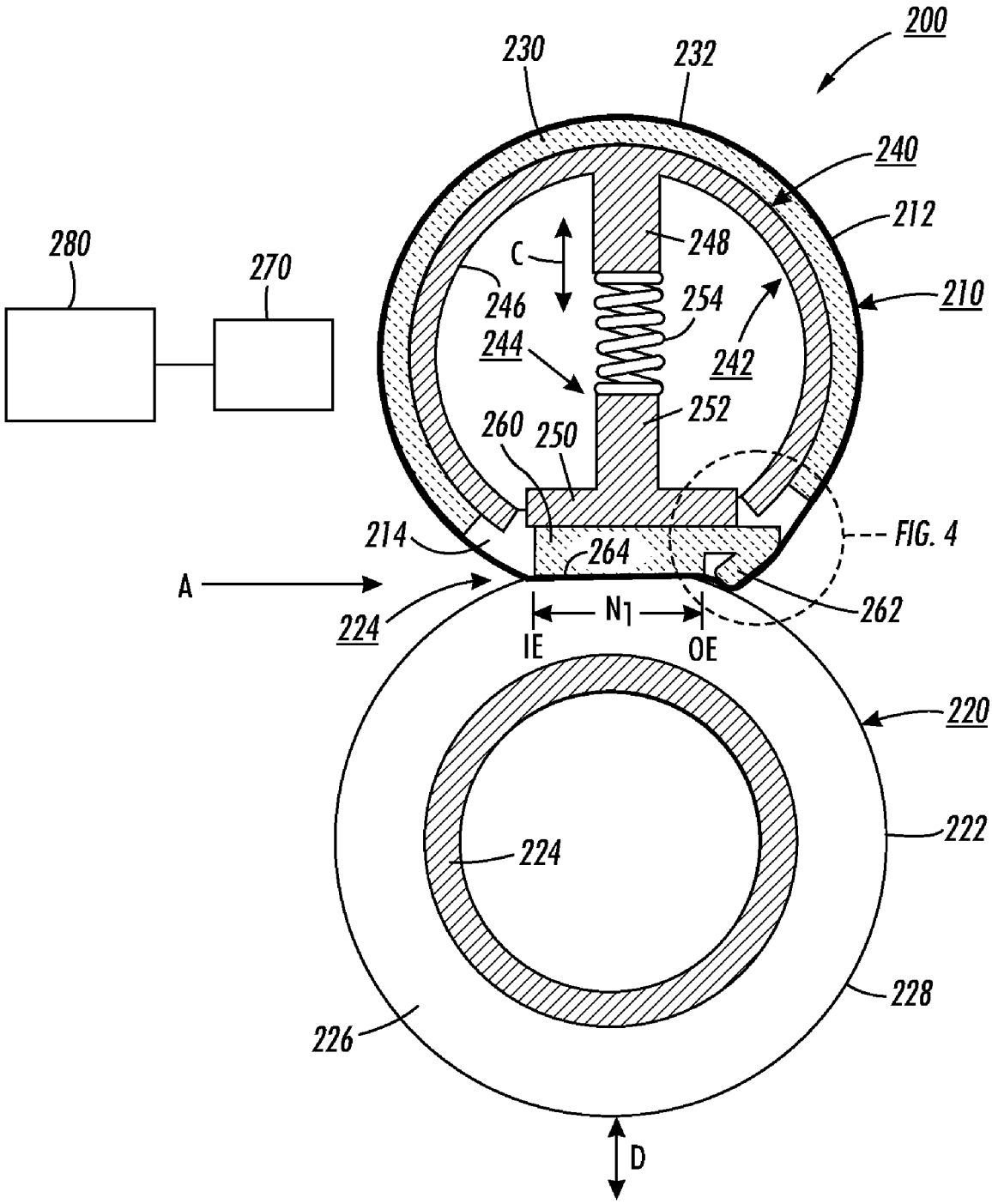
FIG. 2 is a partial cross-sectional view of an exemplary embodiment of a fixing device.

FIG. 2 illustrates an exemplary embodiment of the apparatuses useful in printing. The apparatus is a fuser 200 for fixing marking material on media. Embodiments of the fuser 200 can be used in various printing apparatuses, e.g., in the printing apparatus 100 shown in FIG. 1 in place of the fuser 110.

The fuser 200 includes a continuous fuser belt 210 with an outer surface 212 and inner surface 214. A pressure roll 220 including an outer surface 222 is shown positioned in contact with the outer surface 212 of the fuser belt 210 to form a nip 224. In embodiments, the pressure roll 220 is a drive roll and the fuser belt 210 is driven by engagement with the pressure roll 220, i.e., free-spinning. The pressure roll 220 is rotated clock-wise to cause the belt to rotate counter-clockwise. Media are conveyed through the nip 224 in process direction A. The media can be, e.g., paper sheets with at least one toner image, transparencies, and the like on a surface of the media that is contacted by the outer surface 212 of the fuser belt 210. At the nip 224, opposite faces of the media contact the outer surface 212 of the fuser belt 210 and the outer surface 222 of the pressure roll 220.

Embodiments of the fuser belt 210 can include two or more layers. The layers can each comprise a polymeric material. For example, the fuser belt 210 can include a base layer forming the inner surface 214, an intermediate layer overlying the base layer, and an outer layer forming the outer surface 212, overlying the intermediate layer. The inner layer can be composed of polyimide, or the like; the intermediate layer of silicone, or the like; and the outer layer of a fluoropolymer having low-friction properties, such as polytetrafluoroethylene (Teflon®), or the like. Typically, the base layer can have a thickness of about 50 μm to about 100 μm, the intermediate layer a thickness of about 100 μm to about 300 μm, and the outer layer a thickness of about 10 μm to about 40 μm. The fuser belt 320 can typically has a width of about 215 mm to about 450 mm. In embodiments, the fuser belt 210 is cylindrical shaped when un-deformed. The fuser belt 210 has a thickness and composition that allows it be elastically deformed.

In other embodiments, the fuser belt 210 can be comprised of a metal or metal alloy, such as steel, stainless steel, or the like, forming the base layer. One or more layers can overly the base layer. These layers can include an intermediate layer comprised of an elastic material, such as silicone, or the like, and an outer layer comprised of a fluoropolymer having low-friction properties, such as Teflon®, or the like.

The pressure roll 220 includes a core 224, an inner layer 226 on the core 224, and an outer layer 228 on the inner layer 226. The core 224 can be comprised of a metal, metal alloy, or the like; the inner layer 226 of an elastic material, such as silicone or the like; and the outer layer 228 of a low-friction material, such as Teflon®, or the like.

A heater 230 is located inside of the fuser belt 210. The heater 230 is positioned on a support member 240. The support member 240 is supported on a nip member 260.

In embodiments, the heater 230 is stationary and the fuser belt 210 rotates relative to the heater 230. The heater 230 is configured to heat a substantial portion of the fuser belt 210 rapidly to the desired temperature for fixing marking material onto media at nip 224.

The heater 230 contacts the support member 240 and includes an outer heating surface 232 contacting the inner surface 214 of the fuser belt 210. In embodiments, the heating surface 232 has a curved shape. For example, the heating surface 232 can be semi-circular-shaped, as shown, elliptical-shaped, or the like. In the embodiment, both ends of the heater 230 are circumferentially spaced from the nip member 260, and the entire heater 230 is supported on the support member 240. The heating surface 232 can extend circumferentially over an angle of about 90° up to about the entire portion of the inner surface 214 that does not contact the nip member 260 (i.e., 360°—the angle of the inner surface 214 that is contacted by the nip member 260). For example, the angle can be at least about 120°, at least about 150°, at least about 180°, at least about 210°, at least about 240°, at least about 270°, at least about 300°, at least about 330°, or higher. The heater 230 extends longitudinally or axially along the fuser belt 210. In embodiments, a low-friction backer or support member can be used to support a portion of the fuser belt 210 that is not supported by the heating surface 232 or nip member 260.

In embodiments, at a given maximum thermal output of the heater 230 (e.g., the maximum power density), increasing the arc length of the fuser belt 210 that is heated by contact with the heating surface 232 (i.e., increasing the angle of the heating surface 232) can increase the productivity of the fuser 200. The productivity can be expressed, e.g., as the number of prints per minute of a given media type that can be run in the fuser 200, without exceeding a maximum operating temperature of the fuser belt 210. The heater 230 can be operated at a lower maximum temperature to heat the fuser belt 210 to a given set temperature by increasing the arc length of the fuser belt 210 heated by the heater 230.

In embodiments, the heater 230 is a ceramic heater. The ceramic heater can comprise a single ceramic plate, or multiple ceramic plates. The ceramic plates can be heated quickly to a desired temperature. The plates of the heater 230 can be comprised of one or more suitable ceramic materials. The ceramic materials have sufficiently-high thermal conductivity to transfer thermal energy to the fuser belt 210 rapidly when the heater 230 is activated. For example, the ceramic materials can be selected from quartz, and the like. In embodiments, the heater 230 has a low thermal mass and can be rapidly heated when activated. For example, plates of the heater 230 can have a radial wall thickness of about 0.5 mm to about 5 mm.

The heating surface 232 can have a smooth finish to reduce friction between the heating surface 232 and the inner surface 214 of the fuser belt 210 during rotation of the fuser belt 210.

In embodiments, the heater 230 can include one or more heating elements (not shown) for heating the heating surface 232. The heating elements can extend circumferentially about the heater 230 and along the longitudinal axis of the fuser belt 210. The heating elements can be embedded in the heater 230, and/or provided on an outer surface. The heating elements can be connected to a power supply 270. A controller 280 is connected to the power supply 270 to control the amount of power supplied by the heating elements to heat the fuser belt 210. In embodiments, the heating elements can heat substantially the entire heating surface 232 in contact with the fuser belt 210.

Figure 3:
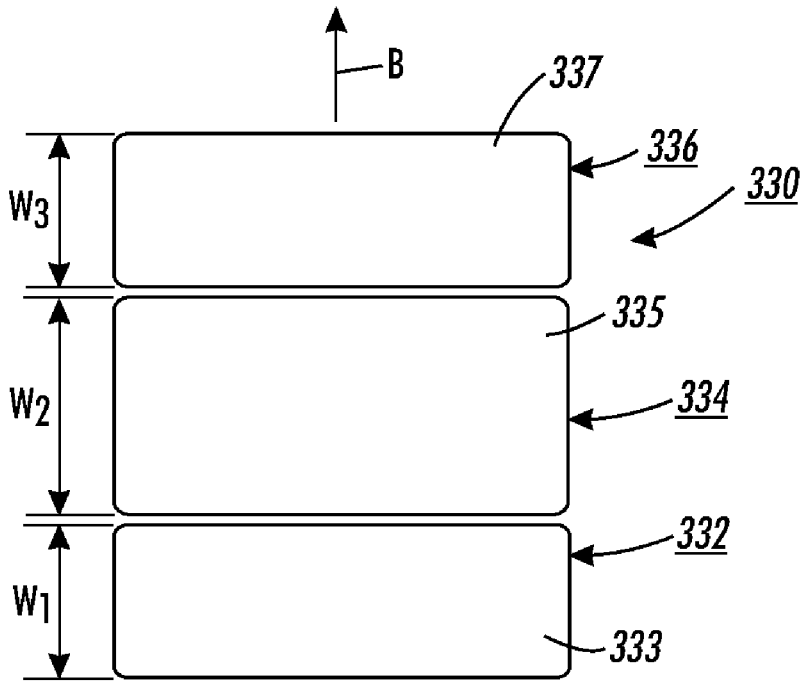
FIG. 3 is a top plan view of an exemplary embodiment of a segmented heater for a fixing device.

In embodiments, the heater 230 can include a plurality of separate heater segments positioned in series along the axial direction of the fuser belt 210. FIG. 3 shows an exemplary embodiment of a segmented heater 330 including three heater segments; namely, a first heater segment 332 having a heating surface 333, a second heater segment 334 having a heating surface 335, and a third heater segment 336 having a heating surface 337. The heating surfaces 333, 335 and 337 contact the inner surface 214 of the fuser belt 210 at axially-spaced locations. The heating surfaces 333, 335 and 337 are curved. For example, the heater segments can each have a semi-circular (ring) configuration, with the same inner diameter and outer diameter, an elliptical configuration, or the like. The heater segments can each comprise a single plate, or multiple plates. As shown, the first heater segment 332 has a width $W_1$, the second heater segment 334 has a width $W_2$, and the third heater segment 336 has a width $W_3$, along the axial direction B. The widths $W_1$, $W_2$ and $W_3$ can be selected based on the size of media typically used in the fuser 200 (i.e., the media dimension along the axial direction B).

In embodiments, the first heater segment 332, second heater segment 334 and third heater segment 336 can each include at least one heating element. The heating element(s) of the first heater segment 332, second heater segment 334 and third heater segment 336, respectively, can be selectively addressed depending on the selected region of the outer surface 212 of the fuser belt 210 to be heated. The region of the outer surface 212 that is to be heated can be determined based on common media widths used in the fuser 200 and the registration of the media (i.e., inboard registered, outboard registered or center registered). The heating elements of the first heater segment 332, second heater segment 334 and third heater segment 336 can be connected to the power supply 270 and controller 280.

As shown in FIG. 2, the support member 240 includes a first member 242 and a second member 244. The first member 242 includes a curved portion 246 and a first wall 248. The curved portion 246 can be semi-circular shaped, for example. In the embodiment, the curved portion 246 contacts the heater 230 over the entire circumferential extent of the heater 230. The second member 244 includes a base 250 and a second wall 252. The support member 240 extends along the longitudinal axis of fuser belt 210. In embodiments, the first member 242 and second member 244 can comprise metallic, ceramic, or composite materials. At least one spring member 254, e.g., at least one compression spring, or the like, is positioned between the first wall 248 and second wall 252. The second member 244 is fixed (stationary) in the fuser 200. The first member 242 can move upwardly and downwardly relative to the second member 244, as indicated by arrows C in FIG. 2. The spring members 254 resiliently bias the first member 242 away from the second member 244 and against the heater 230, which increases tension in the fuser belt 210. The spring forces exerted by the spring members 254 can be selected to control the amount of tension in the fuser belt 210.

The nip member 260 includes a stripping member 262 configured to assist stripping of media from the outer surface 212 of fuser belt 210. The nip member 260 can comprise a single piece of material. The nip member 260 also includes a contact surface 264. The contact surface 264 can be planar, as shown. As shown in FIG. 2, the portion of the fuser belt 210 in contact with the contact surface 264 is elastically deformed to form a first nip, $N_1$ ("primary nip"), with the outer surface 222 of the pressure roll 220. The first nip $N_1$ extends from an inlet end, IE, at which media enter the first nip $N_1$, to an opposite outlet end, OE, at which the media exit the first nip $N_1$.

The position of the pressure roll 220 is adjustable relative to the fuser belt 210 (whose position can be fixed) to adjust the amount of pressure applied by the pressure roll 220 to the fuser belt 210 at the first nip $N_1$. For example, a mechanism can be operatively connected to the pressure roll 220 to move the pressure roll 220 toward or away from the fuser belt 210 as indicated by arrows D to adjust the applied pressure.

The inner layer 226 of the pressure roll 220 is sufficiently compressible when the pressure roll 220 applies pressure to the fuser belt 210 such that the outer layer 228 is depressed to form the first nip $N_1$. Increasing the amount of pressure applied by the pressure roll 220 against the fuser belt 210 increases the degree of deformation of the inner layer 226, which increases the width of the first nip $N_1$ (between the inlet end IE and outlet end OE) formed by contact between the outer surface 222 and outer surface 212 adjacent the contact surface 264 of the nip member 260.

The first nip $N_1$ can typically have a width in the process direction A between the inlet end IE and outlet end OE of about 10 mm to about 15 mm. The nip width can be expressed as the product of dwell time and process speed (i.e., nip width=dwell×process speed). The dwell time is the amount of time that a medium remains in contact with the outer surface 212 of the fuser belt 210 as the medium passes through the first nip $N_1$. A small width of $N_1$ is desirable for light-weight media, while a higher width is desirable for heavy-weight media. At typical process speeds at which media can be fed to the nip 224, the dwell time at the first nip $N_1$ can typically be about 30 ms to about 40 ms. The fuser 200 can typically be run at a printing speed of about 50 to about 100 pages per minute for media weights ranging from light-weight to heavy-weight.

In embodiments, the characteristics of media and images carried on the media can be considered in determining optimum settings in the fuser 200. For example, it is desirable to have increased fusing (i.e., a higher temperature, pressure and/or dwell) for images with large media area coverage, and less fusing (i.e., a lower temperature, pressure and/or dwell) for text documents. The adjustability of the width and pressure of the first nip $N_1$ allows these parameters to be set to optimum levels for different types of media and different images.

The heater 230 can supply sufficient thermal energy to the fuser belt 210 to heat the outer surface 212 to a sufficiently-high temperature to fix different types of marking material on different types of media (e.g., coated or uncoated media with different weights) at the first nip $N_1$ at these dwell times.

In the embodiment of the fuser 200 shown in FIG. 2, the nip member 260 does not include a separate heater to supply thermal energy to the fuser belt 210 at the region of the nip 224. In the embodiment, the fuser belt 210 is directly heated only where the heating surface 232 contacts a portion of the inner surface 212 circumferentially spaced from the nip 224. In the embodiment, the fuser 200 does not include a heater that heats the inner surface 212 at the nip 224. In embodiments, the pressure roll 220 is typically not internally heated. The outer surface 222 is heated by contact with the heated fuser belt 210. A minimum temperature of the outer surface 222 may be desirable prior to print runs.

In other embodiments of the fuser 200, the nip member 260 can also include a heater to supplement the thermal output of the heater 230. In such embodiments, the heater of the nip member 260 supplies thermal energy across the contact surface 264 to heat the fuser belt 210 at the first nip $N_1$.

Figure 4:
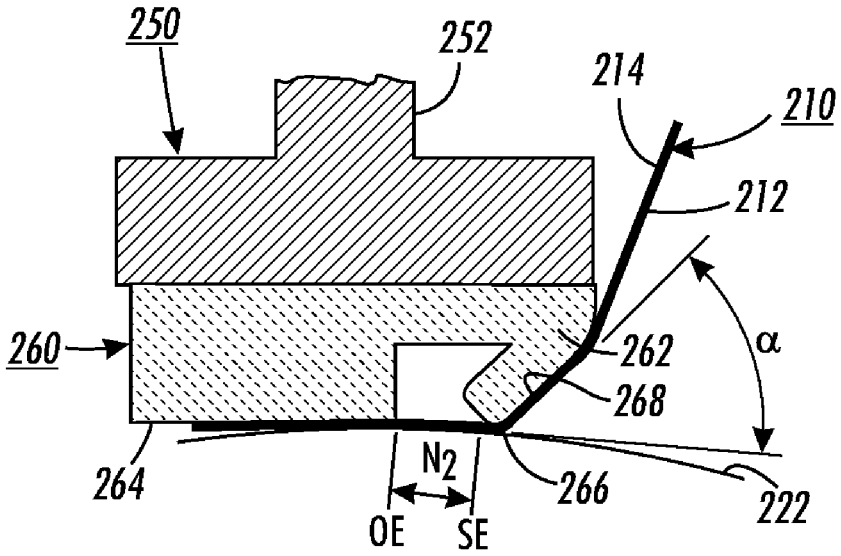
FIG. 4 is an enlarged view depicting a portion of the fixing device shown in FIG. 2.
Figure 5:
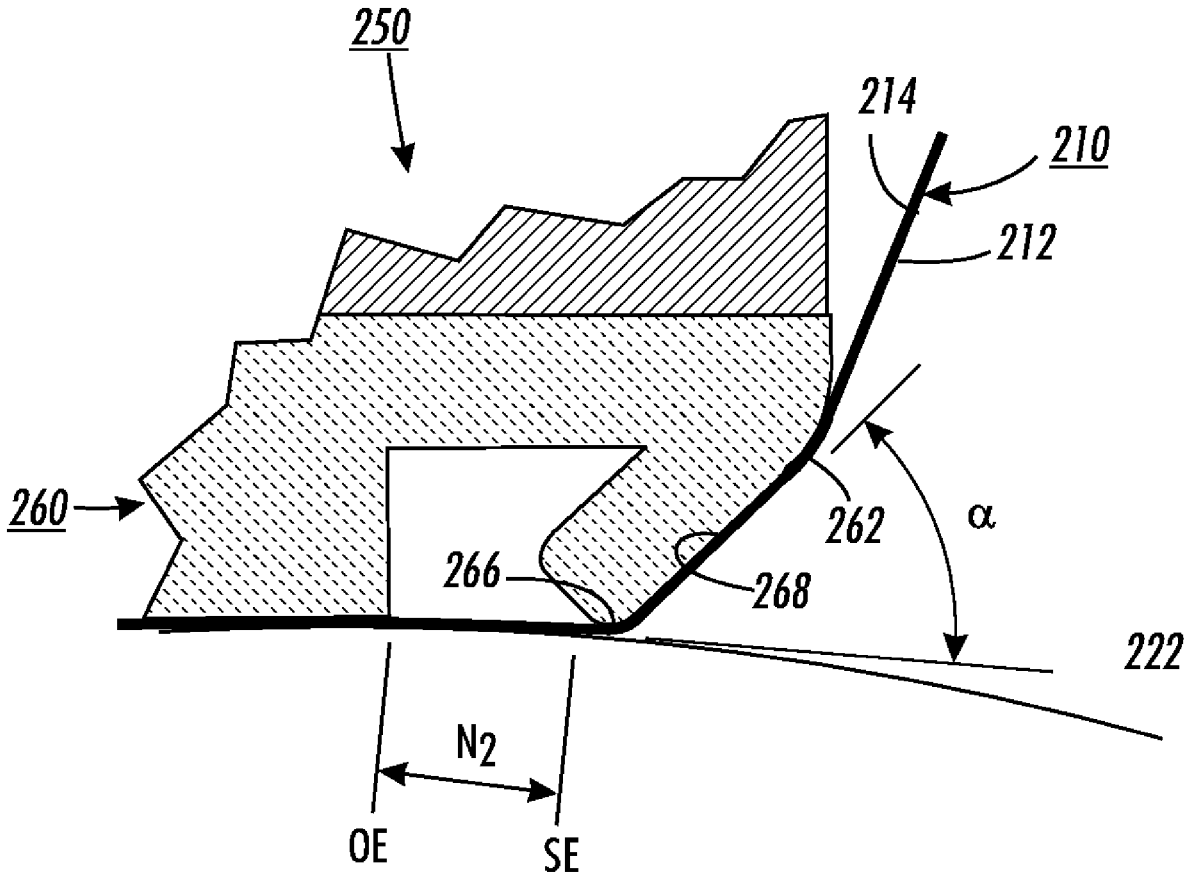
FIG. 5 is an enlarged view depicting a portion of the fixing device shown in FIG. 4.

The portion of the fuser belt 210 adjacent to the outlet end OE of the first nip $N_1$ forms a second nip (or "secondary nip"), $N_2$, by contact between the outer surface 212 and the outer surface 222 of the pressure roll 220. As shown in FIGS. 4 and 5, the second nip $N_2$ extends from about the outlet end OE of the first nip $N_1$ to a stripping end, SE, at which the fuser belt 210 separates from the outer surface 222. The fuser belt 210 contacts the outer surface 222 continuously from the outlet end OE to the stripping end SE.

The stripping member 262 includes a stripping edge 266 and an outer surface 268 extending from the stripping edge 266. At the stripping edge 266, the fuser belt 210 bends at a stripping angle, $\alpha$, away from the outer surface 222 of pressure roll 220. The stripping angle $\alpha$ can typically be from about 15° to about 90°.

The stripping member 262 can be comprised of any suitable material, such as a metal, e.g., steel, aluminum, aluminum alloys, or the like; a polymer, such as a plastic having sufficient wear resistance and temperature resistance, or the like. A coating of a low-friction material can be provided on the stripping edge 266 and outer surface 268 to reduce wear of the inner surface 214 of the fuser belt 210 during its rotation. For example, the low-friction material can be Teflon®, or the like. The stripping member 262 has a sufficient length in the axial direction of the fuser belt 210 to contact the entire dimension of the fuser belt 210 that defines the media path through the nip 224.

In embodiments, the stripping edge 266 of the stripping member 262 has a curvature that produces a sufficiently-high stripping force to mechanically separate (strip) media from the outer surface 212 of the fuser belt 210. For example, the stripping edge 266 can have a semi-circular, parabolic, elliptical, or like shape that provides the desired stripping assistance. For a semi-circular shape, the curvature of the stripping edge 266 is described by a radius. Reducing the radius increases the curvature of the stripping edge 266, and increases the stripping force produced by the stripping edge 266. In embodiments, the radius describing the curvature of the stripping edge 266 can range in length from about 0.5 mm to about 5 mm. Reducing the radius of the stripping edge 266 increases the stripping force. Increasing the stripping angle increases stripping dwell, which allows a higher stripping force to be achieved. The radius of the stripping edge 266 can be based on the type of media most commonly used in the fuser 200. Reducing the curvature of the stripping edge 266 reduces wear of the inner surface 214 of the fuser belt 210. In embodiments, the largest radius (smallest curvature) of the stripping edge 266 that produces a sufficiently-high stripping force to strip the type of media normally run in the fuser 200 can be used to reduce wear of the fuser belt 210. For example, a large radius (small curvature) of about 4 mm to about 5 mm may be desirable in embodiments of the fuser 200 that normally run heavy-weight media. A small radius (large curvature) of about 0.5 mm to about 2 mm may be desirable in embodiments of the fuser 200 that normally run light-weight media.

Although the above description is directed toward fuser apparatuses used in xerographic printing, it will be understood that the teachings and claims herein can be applied to any treatment of marking material on media. For example, the marking material applied on media can be toner, liquid or gel ink, and/or heat- or radiation-curable ink; and/or the media can utilize certain process conditions, such as temperature, for successful printing. The process conditions, such as temperature, pressure and other conditions that are desired for the treatment of ink on media in a given embodiment may be different from the conditions suitable for xerographic fusing.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful in printing, comprising:

a roll including a first outer surface;

a continuous belt including an inner surface and a second outer surface forming a nip by contact with the first outer surface, the belt being driven by rotation of the roll; and a heater disposed inside of the belt, the heater including a circumferentially-extending heating surface contacting the inner surface of the belt over an angle of at least about 90°, wherein the continuous belt has a longitudinal axis, and the heater comprises a plurality of heater segments positioned in series along the longitudinal axis and including respective surfaces together forming the heating surface, each heater segment includes one or more heating elements, and the heating elements of the respective heater segments are separately addressable to heat at least one selected portion of the belt, the heating elements being selectively addressed depending on the selected region of the second outer surface of the continuous belt to be heated, the region of the second outer surface that is to be heated being determined based on one of media widths used and the registration of the media, the registration of the media being one of inboard registered, outboard registered and center registered.

2. The apparatus of claim 1, wherein the heating surface is curved and contacts the inner surface of the belt over an angle of at least about 180°.

3. The apparatus of claim 1, wherein:

the heater comprises ceramic material forming the heating surface; and the belt comprises a first polymeric material forming the inner surface and at least a second polymeric material overlying the first layer and forming the second outer surface.

4. The apparatus of claim 1, further comprising:

a support member comprising a first member including a circumferentially-extending, curved outer surface supporting the heater, a stationary second member, and at least one spring member positioned between the first member and second member;

wherein the at least one spring member resiliently biases the first member away from the second member and against the heater to increase tension in the belt.

5. The apparatus of claim 1, wherein the roll is adjustably movable toward or away from the second outer surface to adjust a pressure applied by the first surface to the belt at the nip and to elastically deform the first surface to adjust a dimension of the nip extending in a process direction of the apparatus.

6. The apparatus of claim 1, further comprising a stripping member disposed inside of the belt, the stripping member including a surface configured to contact the inner surface of the belt to produce a stripping force effective to assist stripping of media from the second outer surface after the media exit from the nip.

7. The apparatus of claim 6, further comprising a stationary nip member comprising the stripping member and a planar surface contacting the inner surface of the belt at the nip.

8. A method of treating marking material on media, comprising:

feeding a medium with marking material thereon to the nip of the apparatus of claim 1;

supplying thermal energy to the belt with the heater as the belt is rotated by rotating the roll to heat the second outer surface; and contacting the medium with the first outer surface and the heated second outer surface at the nip to treat the marking material.

9. An apparatus useful in printing, comprising:

a roll including a first outer surface;

a continuous belt including an inner surface and a second outer surface, the belt being driven by rotation of the roll;

a first nip formed by the second outer surface contacting the first outer surface, the first nip including an inlet end where media enter the first nip and a first outlet end where media exit the first nip;

a second nip formed by the second outer surface contacting the first outer surface adjacent the outlet end of the first nip, the second nip extending from about the first outlet end of the first nip to a second outlet end;

a heater disposed inside of the belt, the heater including a heating surface contacting the inner surface of the belt; and a stripping member disposed inside of the belt, the stripping member including a surface configured to contact the inner surface of the belt to produce a stripping force effective to assist stripping of media from the second outer surface after the media exit from the first nip, wherein the continuous belt has a longitudinal axis, and the heater comprises a plurality of heater segments positioned in series along the longitudinal axis and including respective surfaces together forming the heating surface, each heater segment includes one or more heating elements, and the heating elements of the respective heater segments are separately addressable to heat at least one selected portion of the belt, the heating elements being selectively addressed depending on the selected region of the outer surface of the continuous belt to be heated, the region of the outer surface that is to be heated being determined based on one of media widths used and the registration of the media, the registration of the media being one of inboard registered, outboard registered and center registered.

10. The apparatus of claim 9, wherein the stripping member includes a curved stripping edge contacting the inner surface of the belt, the stripping edge being configured to produce a sufficiently-high stripping force to mechanically separate media from the second outer surface after the media exit from the first outlet end of the first nip.

11. The apparatus of claim 10, further comprising a stationary nip member comprising the stripping member and a first planar surface contacting the inner surface of the belt at the first nip, the stripping member including a second planer surface contacting the inner surface adjacent the stripping edge.

12. The apparatus of claim 10, wherein the belt contacts the stripping edge adjacent the second outlet end of the second nip and bends in a direction away from the first outer surface of the roll at the stripping edge.

13. The apparatus of claim 9, wherein the roll is adjustably movable toward or away from second outer surface to adjust a pressure applied by the first outer surface to the belt and to elastically deform the first surface to adjust a dimension of the first nip extending in a process direction of the apparatus.

14. The apparatus of claim 9, further comprising a support member comprising a first member including a circumferentially-extending, curved outer surface supporting the heater, a stationary second member, and at least one spring member positioned between the first member and second member;

wherein the at least one spring member resiliently biases the first member away from the second member and against the heater to increase tension in the belt.

15. A method of treating marking material on media, comprising:

feeding a medium with a marking material thereon to the first nip of the apparatus of claim 9;

supplying thermal energy to the belt with the heater as the belt is rotated by rotation of the roll to heat the second outer surface;

contacting the medium with the first outer surface and the heated second outer surface at the first nip to treat the marking material; and stripping the medium from the second outer surface with the stripping member after the medium exits from the first outlet end of the first nip.

16. An apparatus useful in printing, comprising:

a roll including a first outer surface;

a continuous belt including an inner surface and a second outer surface forming a nip by contact with the first outer surface, the belt being driven by rotation of the roll; and a heater disposed inside of the belt, the heater including a heating surface contacting a portion of the inner surface of the belt circumferentially spaced from the nip;

wherein the apparatus does not include a heater that heats the inner surface of the belt at the nip, wherein the continuous belt has a longitudinal axis, and the heater comprises a plurality of heater segments positioned in series along the longitudinal axis and including respective surfaces together forming the heating surface, each heater segment includes one or more heating elements, and the heating elements of the respective heater segments are separately addressable to heat at least one selected portion of the belt, the heating elements being selectively addressed depending on the selected region of the outer surface of the continuous belt to be heated, the region of the outer surface that is to be heated being determined based on one of media widths used and the registration of the media, the registration of the media being one of inboard registered, outboard registered and center registered.

17. The apparatus of claim 16, wherein:

the heater comprises ceramic material forming the heating surface; and the belt comprises a first polymeric material forming the inner surface and at least a second polymeric material overlying the first layer and forming the second outer surface.

18. The apparatus of claim 16, further comprising:

a support member comprising a first member including a curved outer surface supporting the heater, a stationary second member, and at least one spring member positioned between the first member and second member; wherein the at least one spring member resiliently biases the first member away from the second member and against the heater to increase tension in the belt.

19. The apparatus of claim 16, wherein the roll is adjustably movable toward or away from second outer surface to adjust a pressure applied by the first outer surface roll to the belt at the nip and to elastically deform the first surface to adjust a dimension of the nip extending in a process direction of the apparatus.

20. The apparatus of claim 16, further comprising a stripping member disposed inside of the belt, the stripping member including a surface configured to contact the inner surface of the belt to produce a stripping force effective to assist stripping of media from the second outer surface after the media exit from the nip.

21. The apparatus of claim 20, further comprising a stationary nip member comprising the stripping member and a first planar surface contacting the inner surface of the belt at the nip, the stripping member including a second planar surface contacting the inner surface.

22. The apparatus of claim 16, wherein the heating surface is curved and contacts the inner surface of the belt over an angle of at least about 90°.

23. A method of treating marking material on media, comprising:

feeding a medium with a marking material thereon to the nip of the apparatus of claim 16;

supplying thermal energy to the belt with the heater as the belt rotates to heat the second outer surface; and contacting the medium with the first outer surface and the heated second outer surface at the nip to treat the marking material.

* * * * *